US010035164B2

(12) United States Patent
Bolman

(10) Patent No.: US 10,035,164 B2
(45) Date of Patent: Jul. 31, 2018

(54) SPRAY NOZZLE ASSEMBLY WITH ONE PIECE SPRAY NOZZLE AND QUICK DISCONNECT RETENTION CAP

(71) Applicant: Spraying Systems Co., Wheaton, IL (US)

(72) Inventor: Bart R Bolman, Montgomery, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 15/708,787

(22) Filed: Sep. 19, 2017

(65) Prior Publication Data

US 2018/0078962 A1 Mar. 22, 2018

Related U.S. Application Data

(60) Provisional application No. 62/396,641, filed on Sep. 19, 2016.

(51) Int. Cl.

| | |
|---|---|
| ***B05B 1/00*** | (2006.01) |
| ***B05B 13/02*** | (2006.01) |
| ***B05B 7/24*** | (2006.01) |
| ***B05B 1/20*** | (2006.01) |

(52) U.S. Cl.

CPC ..... *B05B 13/0278* (2013.01); *B05B 1/20* (2013.01); *B05B 7/2491* (2013.01)

(58) Field of Classification Search

CPC ..... B05B 13/0278; B05B 1/20; B05B 7/2491

USPC ..... 239/418, 523, 524, 550, 600

See application file for complete search history.

(56) References Cited

U.S. PATENT DOCUMENTS

| | | | | |
|---|---|---|---|---|
| 5,190,224 A * | 3/1993 | Hamilton | B05B 15/65 | 239/600 |
| 5,421,522 A * | 6/1995 | Bowen | B05B 1/00 | 239/600 |
| 6,398,128 B1 * | 6/2002 | Hamilton | B05B 1/042 | 239/600 |

* cited by examiner

*Primary Examiner* — Steven J Ganey

(74) *Attorney, Agent, or Firm* — Leydig, Voit & Mayer, Ltd.

(57) ABSTRACT

A spraying apparatus comprising a plurality of spray nozzle assemblies mounted along a liquid supply boom. The spray nozzle assemblies each include a one piece spray nozzle and retention cap (20) having an upstream cap section (21) and a downstream nozzle section (22) integral with the cap section. The cap section (21) is formed with internal camming and locking grooves (25) for drawing the cap section into mounted position on a liquid inlet stem (12) as an incident to rotation of the cap, and the nozzle section (22) has a liquid inlet passage (41) communicating with the inlet stem (12) for directing a discharging liquid spray. A pre-orifice insert (60) is mounted within the spray nozzle and retention cap (20) which has a smaller diameter nozzling passage section, and an intermediate section (24) of the one piece spray nozzle and retention cap (20) is formed with air passageways communicating between the pre-orifice liquid flow passage and outside ambient air.

20 Claims, 6 Drawing Sheets

SPRAY NOZZLE ASSEMBLY WITH ONE PIECE SPRAY NOZZLE AND QUICK DISCONNECT RETENTION CAP

CROSS-REFERENCE TO RELATED APPLICATIONS

This patent application claims the benefit of U.S. Patent Application No. 62/396,641, filed Sep. 19, 2017, which is incorporated by reference.

FIELD OF THE INVENTION

The present invention relates generally to spray nozzle assemblies, and more particularly, to spray nozzle assemblies which have a plurality of discharge orifices and are susceptible to quick disconnect assembly and disassembly from a liquid supply boom or the like.

BACKGROUND OF THE INVENTION

Quick disconnect spray nozzle assemblies are used in a wide variety of agricultural applications. Agricultural sprayers typically comprise an elongated liquid supply boom having large numbers of spray nozzle assemblies mounted in spaced relation along the boom. It is desirable to permit quick and easy assembly, removal and replacement of the spray nozzles from the boom for cleaning or replacement for particular spray applications. For this purpose, it is known to assembly the spray nozzle within a retention cap, which in turn, is adapted for quick disconnect mounting on a liquid supply stem mounted in fluid communication with the boom. The spray nozzle and retention cap typically are individually produced by plastic injection molding.

While it often is desirable to minimize the manufacture and cumbersome handling of a multiplicity of parts, due to the complexity of the spray nozzle, which often desirably includes a multiplicity of intricately configured discharge orifices, and the quick disconnect retention cap, which commonly include internal camming and locking elements, heretofore it has been the practice to separately provide such parts, as long taught in the prior art, including applicant's prior U.S. Pat. Nos. 4,527,745; 5,190,222; 5,275,340; 5,333,794; 6,749,134; 5,333,794; and 7,380732.

OBJECTS AND SUMMARY OF THE INVENTION

It is an object of the present invention to provide a quick disconnect spray nozzle assembly adapted for easier handling and more economical manufacture.

Another object is to provide a spray nozzle assembly as characterized above which has a one piece spray nozzle and retention cap that is susceptible to economical production by plastic injection molding.

A further object is to provide a quick disconnect spray nozzle assembly of the above kind which has a multiplicity of intricately configured liquid spray discharge orifices.

Yet another object is to provide a one piece spray nozzle and retention cap of the foregoing type that is designed for receiving an air induction pre-orifice insert for facilitating liquid atomization during spraying.

Other objects and advantages of the invention will become apparent upon reading the following detailed description and upon reference to the drawings.

Figure 1:
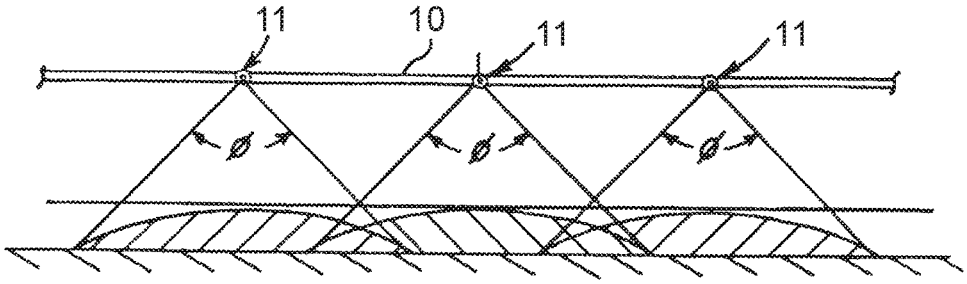
FIG. 1 is a partially diagrammatic depiction of a plurality of spray nozzle assemblies embodying the present invention mounted in laterally spaced relation to along a spray boom.
Figure 2:
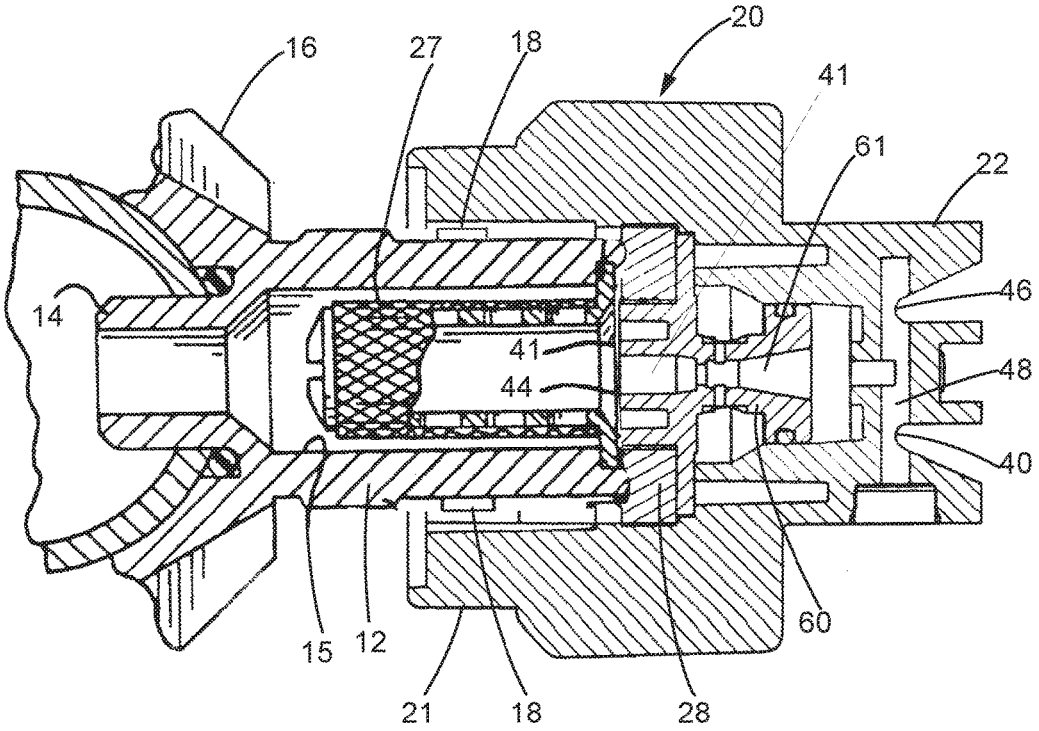
FIG. 2 is an enlarged fragmentary section of one of the spray nozzle assemblies in mounted relation to the spray boom.
Figure 3:
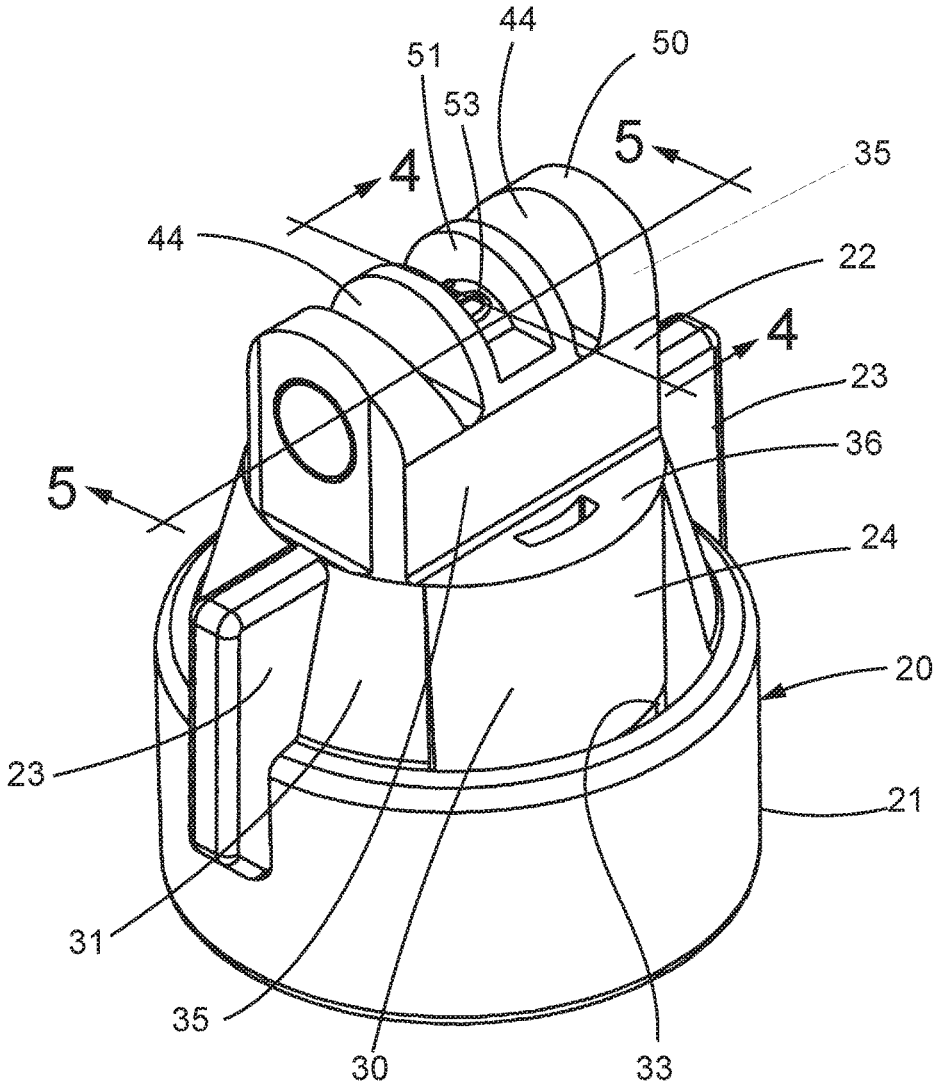
FIG. 3 is an enlarged perspective of one of the spray nozzle assemblies.
Figure 4:
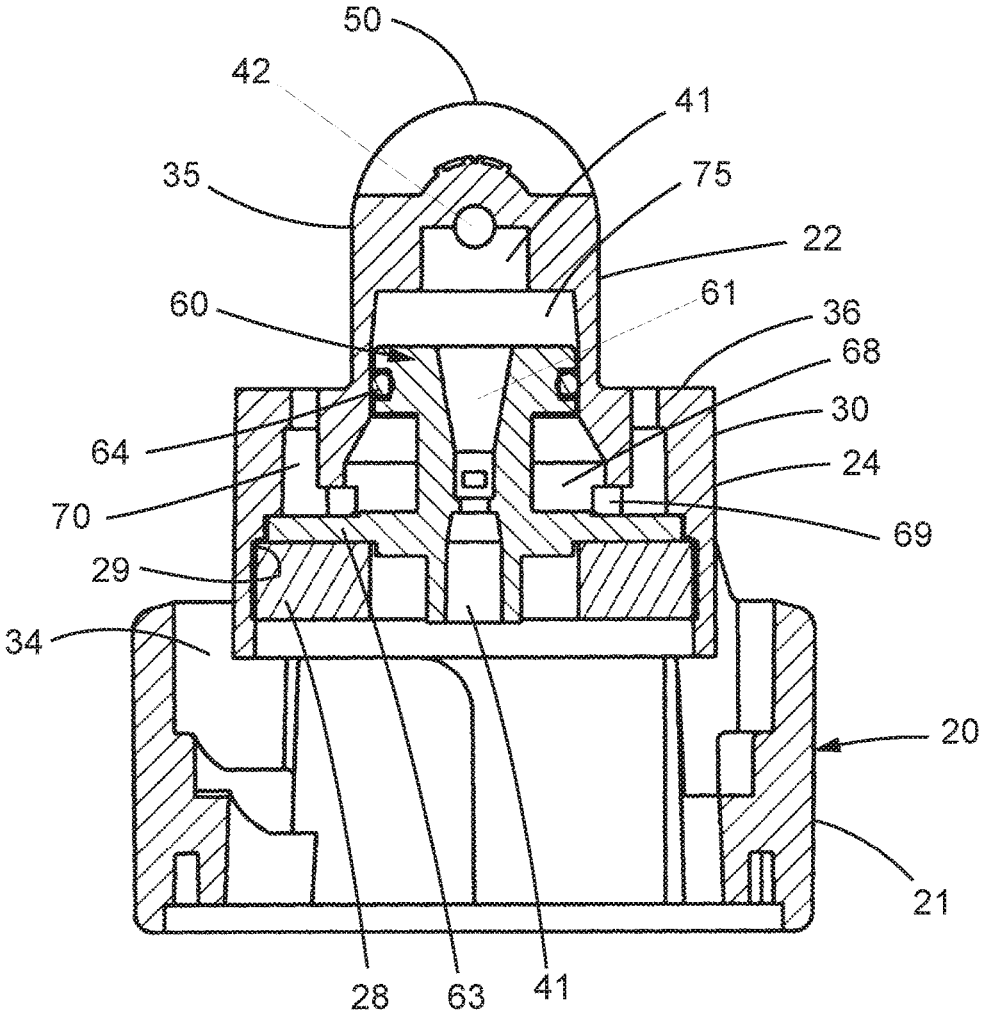
FIG. 4 is a longitudinal section of the spray nozzle assembly shown in FIG. 3, taken in plane of line 4-4.
Figure 5:
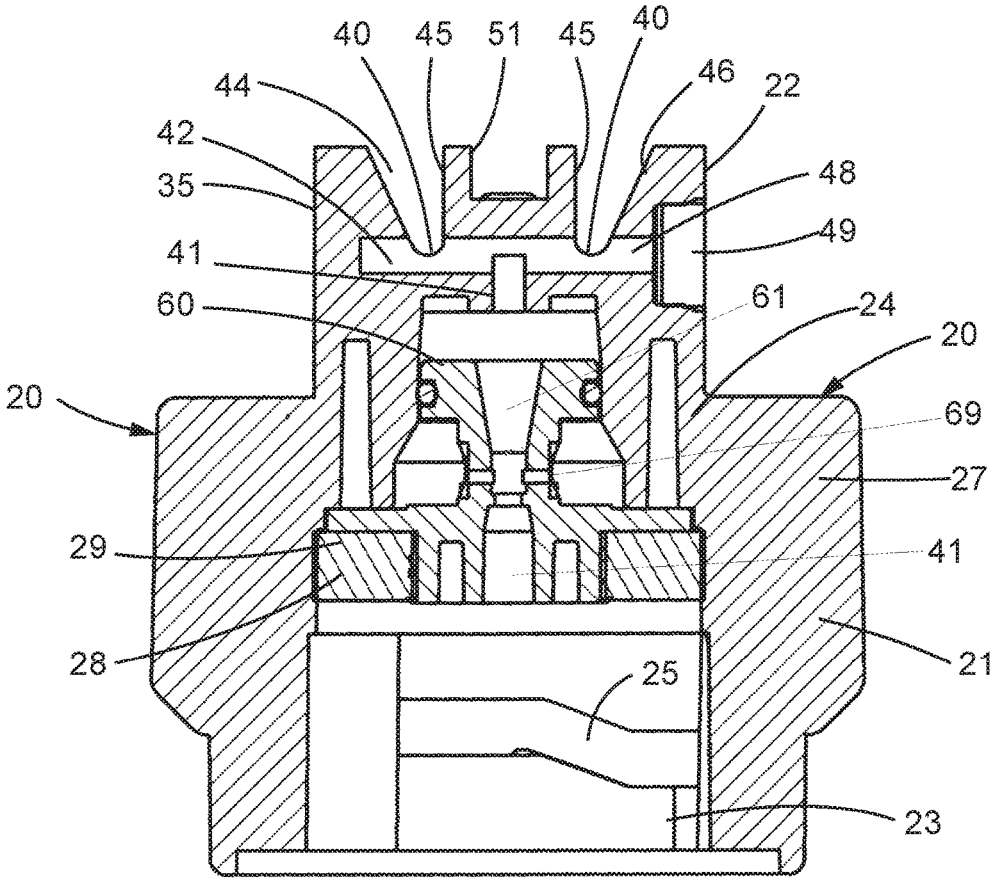
FIG. 5 is a longitudinal section of the spray nozzle assembly shown in FIG. 3, taken in plane of line 5-5.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENT

Referring now more particularly to the drawings, there is shown a spray boom 10, such as the boom of an agricultural sprayer, having mounted thereon a plurality of spray nozzle assemblies 11 in accordance with the invention. The boom 10 in this instance is a tubular member through which the supply liquid is directed. Each spray nozzle assembly 11 includes a liquid inlet stem 12 having a nipple 14 extending into the boom 10 through an aperture in one side thereof. Pressurized liquid supplied to the boom 10 enters the stem 12 through the nipple 14 and passes through a central fluid passageway 15 in the stem 12 for direction through and discharge from the spray nozzle assembly 11 mounted at the outer terminal end thereof. The stem 12 is secured to the boom 10 by appropriate means, such as a clamp 16, and has a pair of diametrically opposed locking lugs 18 adjacent an outer end.

In accordance with the invention, the spray nozzle assembly 11 includes a one-piece spray nozzle and retention cap 20 adapted for easy handling and economical plastic injection molding. The illustrated spray nozzle and retention cap 20 includes an upstream cap section 21, a downstream nozzle section 22, and an intermediate section 24 between and integral with the cap and nozzle sections 21, 22.

The cap section 21 has a cylindrical shape with an open upstream end adapted for telescopic positioning over the outer end of the liquid inlet stem 12. The cap section 21 has internally formed axially oriented entry slots 23 for positioning over the locking lugs 18 of the stem 21 and annular camming and locking grooves 25 for drawing the cap section 21 onto the stem 12 into a locked condition as an incident to rotation of the cap section 21 onto the stem 12, as disclosed in U.S. Pat. No. 4,527,745 assigned to the same applicant as the present application, the disclosure of which is incorporated herein by reference. As an incident to such rotary mounting of the cap section 21 onto the stem 12, the axial end of the stem 12 is drawn into sealed relation with an annular seal 28 seated in a counter bore 29 in an upstream end of the intermediate section 24. An annular strainer 27 is retained in interposed relation between the annular seal 28 and the end of the stem 12 in a conventional manner. To facilitate rotary mounting of the cap section 21 onto the stem 12, the cap section 21 has a pair of outwardly extending diametrically opposed gripping ears 27.

The intermediate section 24 of the one-piece spray nozzle and retention cap 20 in this instance is defined by opposed semi-cylindrical wall sections 30 smaller in diameter than the outer wall of the cap section 21 and are supported downstream of the cap section 21 by opposed inwardly tapered frustoconical wall sections 31 integral with the cap section 21. A pair of circumferentially spaced air spaces 34 in this case are defined between the semi-circular walls 30 of the intermediate section 21 and the larger diameter outer wall of the cap section 21.

The nozzle section 22 of the unitary spray nozzle and retention cap 20 in this instance is in the form of an elongated generally rectangular member 35 as viewed from a downstream end of the nozzle section 22, integrally formed in transverse relation to an end wall 36 of the intermediate section 24. The intermediate section end wall 36 in this case extends in semi-cylindrical fashion from opposite elongated sides of the nozzle section rectangular member 35.

In carrying out the invention, the nozzle section 22 is formed with a plurality of liquid discharge orifices 40 for simultaneous and more complete spray coverage from the nozzle section 22. The illustrated nozzle section 22 is formed with a pair of discharge orifices 40 adjacent opposite ends of the elongated rectangular member 35. The nozzle section 22 has an inlet passage 41 communicating with the liquid supply stem 12, as will become apparent, and a downstream transverse chamber 42. The illustrated discharge orifices 40 are defined by cross slots 44 extending into the rectangular member 35 into intersecting relation with the transverse chamber 42 adjacent its opposite ends.

The illustrated discharge orifices 40 each have an upstream face 45 that is vertically oriented and a downstream face or deflector surface 46 disposed at a small angle to the vertical, such as 30° . The discharge orifice defining cross slots 44 each are disposed upstream of a respective end of the transverse chamber 42 so as to define a distinct pocket or recess 48 downstream of the deflector surface 46. The illustrated discharge orifice defining cross slots 44 extend into the horizontal chamber a distance slightly less than the radius of the horizontal chamber. To facilitate plastic injection molding of the nozzle section 22, it will be appreciated by one skilled in the art that the nozzle section 22 may be formed with a transverse chamber 42 that is open at one end, which can thereafter be closed by a plastic plug 49 secured by ultrasonic welding.

The nozzle section rectangular member 35 has a semi-cylindrical end face 50 with a central transverse cross slot 51 is formed in parallel relation to the discharge orifice defining cross slots 42. A nozzle marking size indicia 53 or the like may be provided on the nozzle section within the central cross slot 51.

Figure 6:
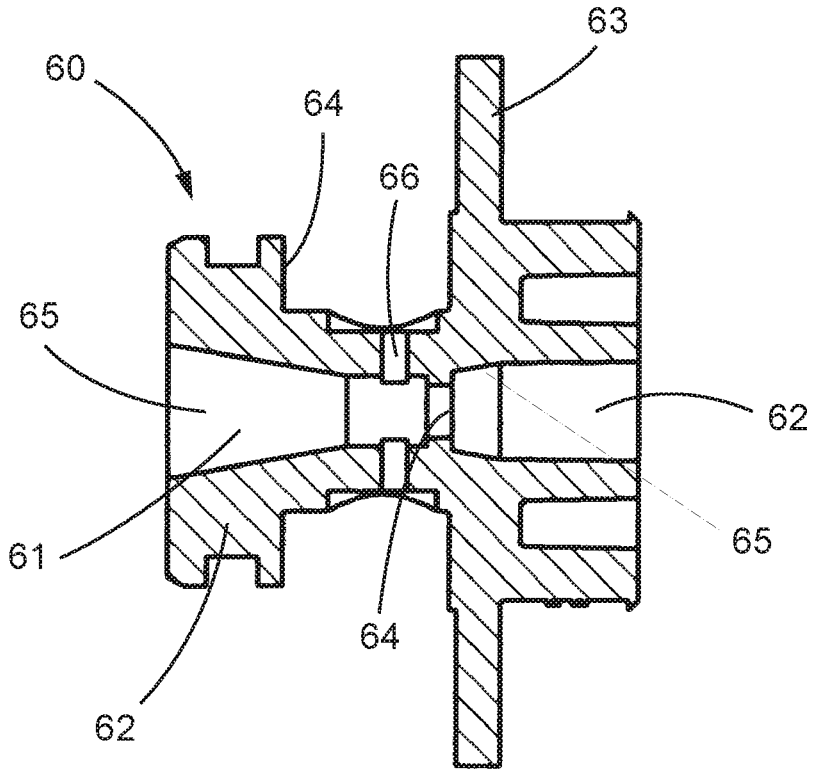
FIG. 6 is a side elevational view of an air induction and pre-orifice insert of the spray nozzle assembly shown in FIG. 3.

In carrying out a further feature of this embodiment, to facilitate liquid atomization, housed within a central cavity of the intermediate section 24 of the unitary spray nozzle and retention cap 20 is a pre-orifice insert 60 designed for accelerating liquid flow to the nozzle section while drawing in a controlled flow of ambient air for optimum liquid atomization. The pre-orifice insert 60 (FIG. 6) is formed with a central liquid flow passage 61 communicating with the liquid supply from the stem 12. For supporting the pre-orifice insert 60 within the intermediate section 24, the pre-orifice insert 60 has an enlarged annular flange 63 intermediate its ends mounted between the sealing gasket 28 and a counter bore in the intermediate section 24, as well as a downstream annular hub 62 mounted within a smaller diameter section of an internal cavity of the intermediate section 24 with an annular sealing ring 64 interposed therebetween. The central liquid flow passage 61 of the pre-orifice insert includes a liquid inlet section 62, a relatively small diameter nozzling section 64, and an outwardly opening conical discharge section 65.

For metering predetermined quantities of ambient air into an accelerated liquid flow stream through the nozzling section 64 of the pre-orifice insert 60, the pre-orifice insert 60 has a plurality of radial air passageways 66 communicating immediately downstream of the nozzling section 64 between the nozzling passage section 64 and an annular air chamber 68 defined within the cavity of the intermediate section 24 about the pre-orifice insert 60 between the retaining flange 63 and the downstream hub 62. The annular air cavity 68 communicates with ambient air through a plurality of radial passages 69, and in turn, longitudinal passages 70 parallel to the central axis of the spray nozzle assembly which extend through the end face 36 of the intermediate section 24.

During a spray operation, it will be seen that a liquid flow stream directed into the pre-orifice insert 60 is accelerated in the nozzling section 64, causing a low pressure in the transverse air passages 66 for drawing ambient air into the liquid flow stream for enhanced atomization upon discharge into an expansion chamber 75 of the nozzle section 21 immediately downstream of the insert 60. The atomized liquid particles then proceed through the inlet passage 41 transverse chamber 42 and discharge orifices 40 with further liquid particle atomization. The discharging sprays from the discharge orifices 40 in this instance are directed slightly outwardly of the longitudinal axis of the spray nozzle assembly for enabling simultaneous and complete coverage of a canopy of agricultural crops or the like to be sprayed. It will be understood that the nozzling section, expansion chamber 64, expansion chamber 75, transverse chamber 42, and discharge orifices 40 may be designed to create discharging sprays without very fine particles that are subject to undesirable drip.

From the forgoing, it can be seen that a quick disconnect spray nozzle assembly is provided that has a unitary spray nozzle and unitary cap construction adapted for economical manufacture and easy handling. The spray nozzle assembly may have a multiplicity of intricately configured discharge orifices and be used with an internally contained pre-orifice insert for desired ambient air induced liquid atomization. While in the illustrated embodiment, the nozzle section is formed with two discharge orifices, alternatively, it could be formed with differently configured and greater numbers of discharge orifices.

The invention claimed is:

1. A liquid spray nozzle (10) for mounting on a liquid inlet stem (12) having external locking lugs (18) comprising:

a one piece spray nozzle and retention cap (20) having an upstream cap section (21) and a downstream nozzle section (22) integral with the cap section (21);

said cap section (21) being formed with camming and locking grooves (25) for drawing the cap section (21) onto said liquid inlet stem (12) and into a locked position as an incident to rotation of the cap section (21) onto the liquid inlet stem (12); and said nozzle section (22) having a liquid inlet passage (41) communicating with said liquid inlet stem (12) when in said locked position and at least one discharge orifice (40) communicating with the nozzle section liquid inlet passage (41) for directing a liquid spray discharge from the nozzle section (22).

2. The liquid spray nozzle of claim 1 in which said nozzle section 22 is formed with a transverse chamber (42) communicating with said nozzle section liquid inlet passage (41), and said nozzle section (22) having a plurality of said discharge orifices (40) each defined by a respective cross slot (51) in an end of said nozzle section (22) communicating with said transverse chamber (42).

3. The liquid spray nozzle of claim 1 in which said one piece spray nozzle and air cap (20) includes an intermediate section (24) between and integral with said cap section (21) and nozzle section (22).

4. The liquid spray nozzle of claim 1 including an annular seal (28) disposed within said one piece spray nozzle and retention cap (20) for positioning in sealed engagement with an end of said liquid inlet stem (12).

5. The liquid spray nozzle of claim 1 in which the cap section (21) of said one piece spray nozzle and retention cap (20) has a pair of outwardly extending diametrically opposed gripping ears (27) to facilitate assembly and disassembly of the one piece spray nozzle and retention cap (20) on the liquid inlet stem (12).

6. The liquid spray nozzle of claim 3 in which the intermediate section (24) of the one piece spray nozzle and retention cap (20) is defined in part by semi-cylindrical wall sections (30) smaller in diameter than the cap section (21), and said nozzle section (22) of said one piece spray nozzle and retention cap (22) is an elongated rectangular member (35) as viewed from a downstream end of the nozzle section (22) extending outwardly from an end wall (36) of the intermediate section (24).

7. The liquid spray nozzle of claim 6 in which said nozzle section (22) is formed with a transverse chamber (42) parallel to the elongated rectangular member (35) communicating with said nozzle section inlet passage (41), and said nozzle section (22) having a plurality of said discharge orifices (40) each defined by a respective cross slot (44) in an end of the rectangular member (35) of the nozzle section (22) communicating with the transverse chamber (42).

8. The liquid spray nozzle of claim 1 including a pre-orifice insert (60) mounted within said one piece spray nozzle and retention cap (20) having a pre-orifice central liquid flow passage (61) for communicating with said liquid supply stem (12), said pre-orifice central liquid flow passage (61) including a small diameter nozzling passage section (64) for accelerating liquid flow to the nozzle section (21).

9. The liquid spray nozzle of claim 8 including an annular seal (28) disposed within said one piece spray nozzle and retention cap (20) for positioning in sealed engagement with an end of said liquid inlet stem (12), and said pre-orifice insert (60) having an enlarged diameter mounting flange (63) interposed between said annular seal (28) and said one piece spray nozzle and retention cap (20).

10. The liquid spray nozzle of claim 8 in which said one piece spray nozzle and retention cap (20) has a plurality of ambient air passages (66) communicating between said pre-orifice central liquid flow passage (61) downstream of said nozzling passage section (64) of said pre-orifice insert (60) and ambient air outside said spray nozzle and retention cap (20) through which ambient air is drawn into liquid as an incident to passage of liquid through said pre-orifice small diameter nozzling section (64) for facilitating liquid atomization upon discharge from said discharge orifice (40).

11. The liquid spray nozzle of claim 10 in which said one piece spray nozzle and air cap (20) includes an intermediate section (24) between and integral with said cap section (21) and nozzle section (22), and said ambient air passages (66) communicate through said intermediate section (24).

12. The liquid spray nozzle of claim 8 in which said central liquid flow passage (61) of said pre-orifice insert (60) includes a liquid inlet section (62) communicating upstream with said nozzling section (64) and a downstream outwardly opening conical discharge section (65) communicating downstream with said nozzling section (64).

13. The liquid spray nozzle of claim 12 in which said nozzle section (22) of said one piece spray nozzle and retention cap (20) defines an expansion chamber downstream of said spray pre-orifice insert (60) larger in diameter than the outwardly opening conical discharge section (65) of the pre-orifice insert (60).

14. The liquid spray nozzle of claim 11 in which the pre-orifice insert (60) and intermediate section of said one piece spray nozzle and air cap (20) define an annular chamber communicating between ambient air outside said spray nozzle and retention cap (20) and said pre-orifice insert air passages (66).

15. A liquid spraying apparatus comprising:

a spray boom (10) for connection to a liquid supply;

a plurality of spray nozzle assemblies (11) mounted on the spray boom (10);

said spray nozzle assemblies (11) each including a liquid inlet stem (12) having a central liquid passageway (15) communicating through a side of the spray boom (10);

said spray nozzle assemblies each including a one piece spray nozzle and retention cap (20) having an upstream cap section (21) and a downstream nozzle section (22) integral with the cap section (21);

said cap section (21) being formed with internal camming and locking grooves (25) for drawing the cap section (21) onto said liquid inlet stem (12) and into a locked position as an incident to rotation of the cap section (21) on the liquid inlet stem (12); and said nozzle section (22) having a liquid inlet passage (41) communicating with said liquid inlet stem (12) and at least one discharge orifice (40) communicating with the nozzle section liquid inlet passage (41) for directing a liquid spray discharge form the nozzle section (22).

16. The liquid spraying apparatus of claim 1 in which said one piece spray nozzle and air cap (20) includes an intermediate section (24) between and integral with said cap section (21) and nozzle section (22).

17. The liquid spraying apparatus of claim 15 including a pre-orifice insert (60) mounted within said one piece spray nozzle and retention cap (20) having a pre-orifice central liquid flow passage (61) for communicating with said liquid supply stem (12), said pre-orifice central liquid flow passage (61) including a small diameter nozzling passage section (64) for accelerating liquid flow to the nozzle section (21).

18. The liquid spraying apparatus of claim 17 including an annular seal (28) disposed within said one piece spray nozzle and retention cap (20) for positioning in sealed engagement with an end of said liquid inlet stem (12), and said pre-orifice insert (60) having an enlarged diameter mounting flange (63) interposed between said annular seal (28) and said one piece spray nozzle and retention cap (20).

19. The liquid spraying apparatus of claim 17 in which said one piece spray nozzle and retention cap (20) has a plurality of ambient air passages (66) communicating between said pre-orifice central liquid flow passage (61) downstream of said nozzling passage section (64) of said pre-orifice insert (60) and ambient air outside said spray nozzle and retention cap (20) through which ambient air is drawn into liquid as an incident to passage of liquid through said pre-orifice small diameter nozzling section (64) for facilitating liquid atomization upon discharge from said discharge orifice (40).

20. The liquid spraying apparatus of claim 19 in which said one piece spray nozzle and air cap (20) includes an intermediate section (24) between and integral with said cap section (21) and nozzle section (22), and said ambient air passages (66) communicate through said intermediate section (24).

* * * * *